US007942798B2

(12) United States Patent
Wang

(10) Patent No.: US 7,942,798 B2
(45) **Date of Patent: *May 17, 2011**

(54) RESISTANCE ARRANGEMENT OF A WAIST-TWISTING MACHINE

(76) Inventor: Loao Wang, Taiping (TW)

( * ) Notice: Subject to any disclaimer, the term of this patent is extended or adjusted under 35 U.S.C. 154(b) by 6 days.

This patent is subject to a terminal disclaimer.

(21) Appl. No.: 12/358,225

(22) Filed: Jan. 22, 2009

(65) Prior Publication Data

US 2010/0184571 A1 Jul. 22, 2010

(51) Int. Cl.
*A63B 22/14* (2006.01)

(52) U.S. Cl. ..... 482/147; 482/146

(58) Field of Classification Search ..... 482/122, 482/123, 129, 130, 146, 147, 79, 80
See application file for complete search history.

(56) References Cited

U.S. PATENT DOCUMENTS

| | | | | |
|---|---|---|---|---|
| 4,390,180 | A * | 6/1983 | Simjian | 482/131 |
| 5,645,512 | A * | 7/1997 | Yu | 482/53 |
| 5,695,250 | A * | 12/1997 | Lin | 297/353 |
| 6,149,552 | A * | 11/2000 | Chen | 482/72 |
| 6,582,344 | B2 * | 6/2003 | Tang | 482/53 |
| 6,875,159 | B2 * | 4/2005 | Chuang | 482/51 |
| 6,899,657 | B2 * | 5/2005 | Chuang | 482/52 |
| 6,918,861 | B2 * | 7/2005 | Liao et al. | 482/57 |
| 7,374,518 | B2 * | 5/2008 | Ratner | 482/136 |
| 2003/0092546 | A1 * | 5/2003 | Yu | 482/142 |

* cited by examiner

*Primary Examiner* — Allana Lewin

(57) ABSTRACT

A resistance arrangement of a waist-twisting machine, wherein the waist-twisting machine includes a rotating disc for the lower limb of the operator to stand thereon and swiveled under application of force, a rotating handlebar for the upper limb of the operator to hold thereon and swiveled under application of force, and a coupling mechanism for synchronically and reversely coupling the rotating disc and the rotating handlebar. Moreover, a resistance-adjustable apparatus is interposed between the bottom base and the upright rod transmission shaft.

2 Claims, 3 Drawing Sheets

RESISTANCE ARRANGEMENT OF A WAIST-TWISTING MACHINE

BACKGROUND OF THE INVENTION

1. Fields of the Invention

The invention relates to a resistance arrangement of a waist-twisting machine, and more particularly, to a structure with a resistance-adjustable apparatus for providing a proper exercise resistance for enhancing the waist-twisting exercise effect.

2. Description of the Related Art

As we all know, the so-called "waist twist machine" is a fitness device by which the user may twist his waist and his abdominal muscles to achieve the unique exercise effect. At present, the conventional similar devices almost employ a rotating disc as a structural basis on which a user stands to apply force for its rotation. In use, the user has to hold a fixed handle with his both hands so that his upper body is positioned at a certain angle. At this point, the user twists the lower part of his body to the left and right side. In this way, the fitness exercise of the waist and the abdominal part is achieved.

The above-mentioned fitness device can be easily operated. Moreover, there is no special mechanical design. In taking the exercise effect into account, we find that the rotating disc does not provide a resisting force against the rotation thereof. Therefore, it is not possible for the operator to apply another force for increasing the exercise effect. Thus, the conventional device requires further improvements.

SUMMARY OF THE INVENTION

An object of the invention is to provide a resistance arrangement of a waist-twisting machine that includes a resistance-adjustable apparatus, with which the operator can apply another force, thereby enhancing the expected effect in improving his health and training his muscles.

According to the invention, a resistance-adjustable apparatus for providing a proper exercise resistance is interposed between the bottom base and the upright rod transmission shaft of the waist-twisting machine.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show a preferred embodiment of the invention.

Figure 1:
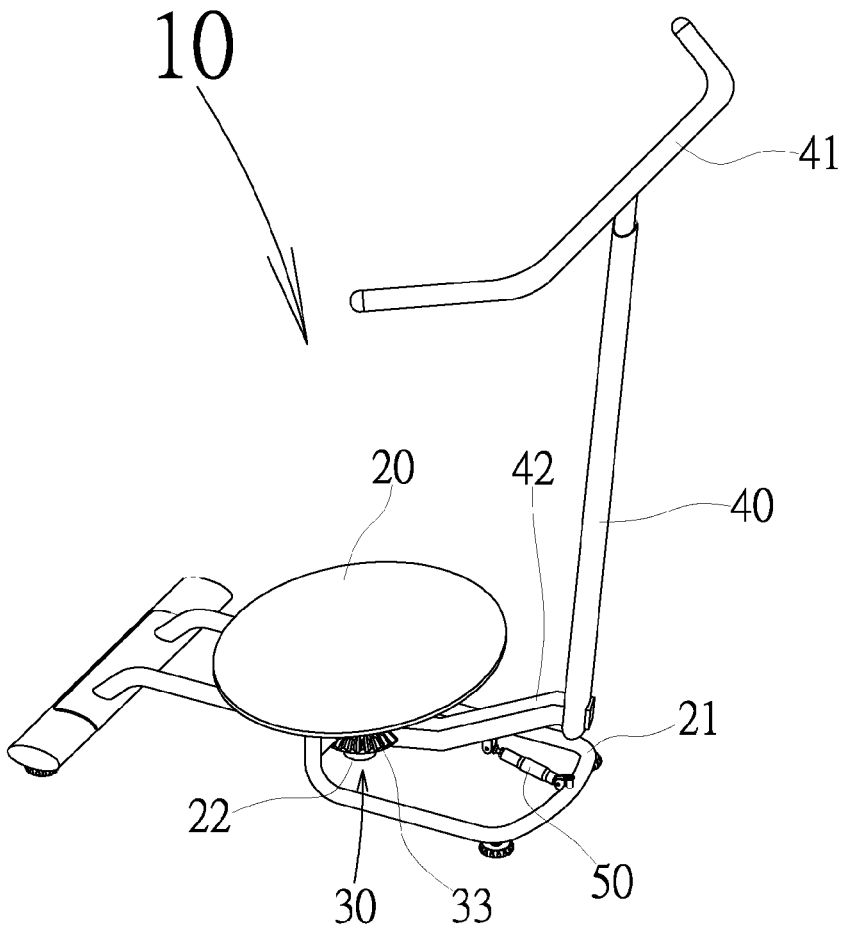
FIG. 1 is a perspective view of a preferred embodiment of the invention.
Figure 2:
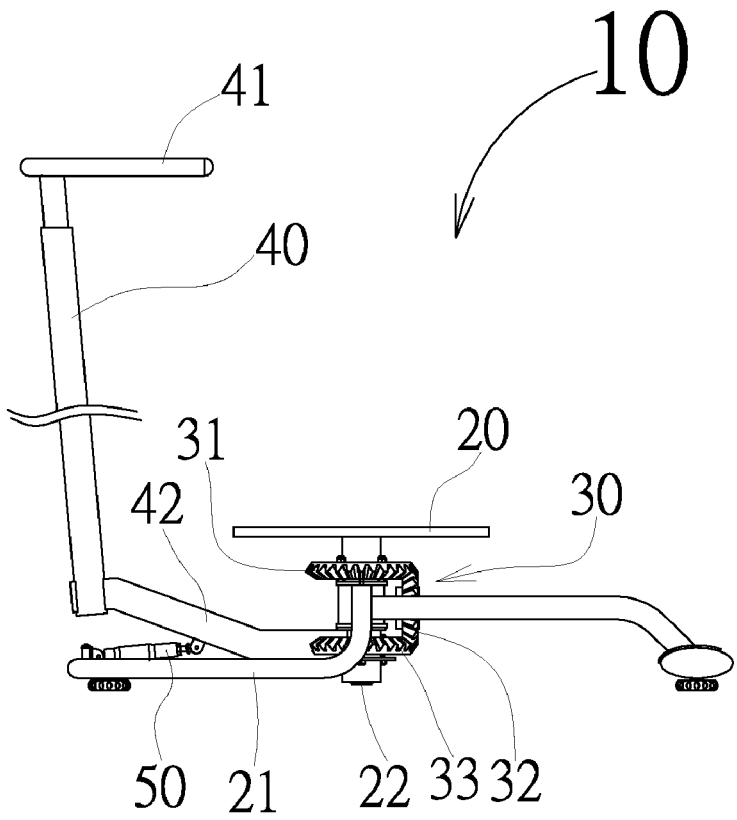
FIG. 2 is a side view of the preferred embodiment of the invention according to FIG. 1.
Figure 3:
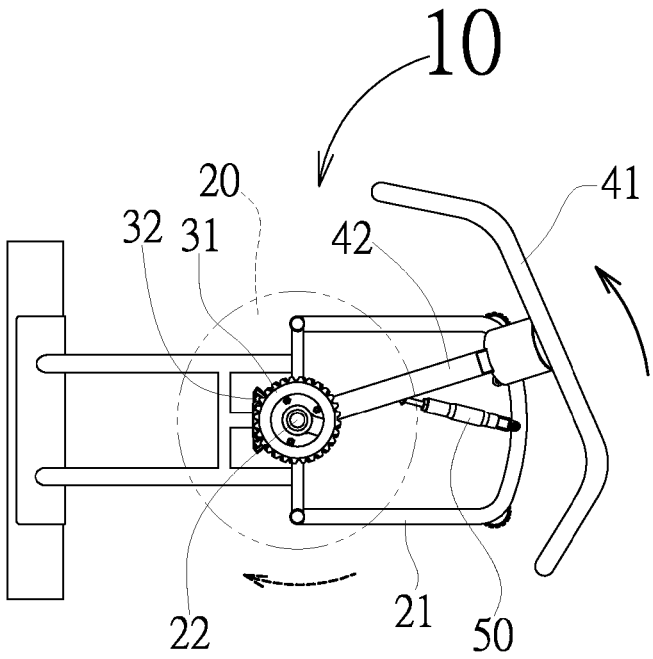
FIG. 3 is a schematic drawing of the preferred embodiment of the invention according to FIG. 1 wherein the operation thereof is illustrated.
Figure 4:
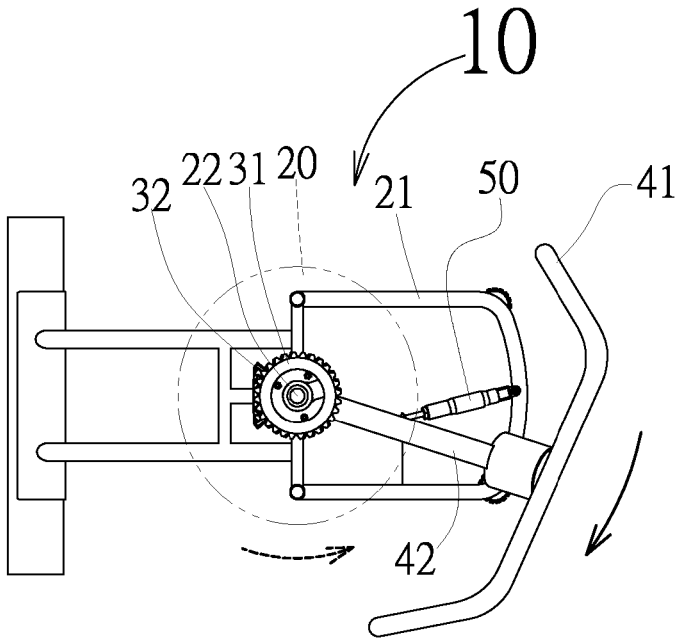
FIG. 4 is a schematic drawing of the preferred embodiment of the invention according to FIG. 1 wherein another operation thereof is illustrated.

Referring to FIGS. 1 and 2, a waist-twisting machine 10 includes a rotating disc 20, a coupling mechanism 30, and a handlebar 40.

The rotating disc 20 acts in cooperation with a bottom base 21 and a supporting post 22 at the center thereof such that the rotating disc 20 is pivotally attached to the top of the supporting post 22 for the lower limb of an operator to stand thereon.

The coupling mechanism 30 is driven by the rotating disc 20. The coupling mechanism 30 includes a primary bevel gear 31 in lateral direction, an intermediate bevel gear 32 extended in longitudinal direction and engaged with the primary bevel gear 31, and a secondary bevel gear 33 engaged with the intermediate bevel gear 32.

The rotating handlebar 40 includes a handlebar 41 at the top thereof for the upper limb of the operator to hold thereon. An upright rod transmission shaft 42 is attached to the bottom thereof and synchronically driven by the secondary bevel gear 33 in reverse rotation relative to the rotating disc 20.

Based on the assembly of the above-mentioned components, the handlebar 41 is synchronically rotated in reverse direction when the rotating disc 20 is subject to a force in rotation. In this way, the upper and lower bodies of the operator may achieve an expected synchronic twisting effect. Likewise, the rotating disc 20 may be reversely and synchronically rotated when the operator applies a force with his upper body to the handlebar 41 for a rotational motion.

Moreover, a resistance-adjustable apparatus 50 for providing a proper exercise resistance is pivotally interposed between the bottom base 21 and the upright rod transmission shaft 42.

Of course, the resistance-adjustable apparatus 50 includes an adjustable hydraulic cylinder, an adjustable pneumatic cylinder or a spring.

In this way, the exercise resistance may be adjusted by the operator according to his own exercise and fitness need for enhancing the expected effect in improving his health and training his muscles.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A resistance arrangement of a waist-twisting machine, wherein the waist-twisting machine includes:

a) a rotating disc acting in cooperation with a bottom base and a supporting post at the center thereof such that the rotating disc is pivotally attached to the top of the supporting post for the lower limb of an operator to stand thereon;

b) a bevel gear coupling mechanism driven by the rotating disc, the coupling mechanism having a primary bevel gear in a lateral direction engaged with the rotating disc, an intermediate bevel gear extended in a longitudinal direction and engaged with the primary bevel gear, and a secondary bevel gear engaged with the intermediate bevel gear; and c) a rotating handlebar having a handlebar at the top thereof for the upper limb of the operator to hold thereon, an upright rod transmission shaft being attached to the bottom thereof and synchronically driven by the secondary bevel gear in reverse rotation relative to the rotating disc; and d) a resistance-adjustable apparatus pivotally interposed between the bottom base and the upright rod transmission shaft, wherein the rotating disc and the rotating handlebar rotate about the same axis.

2. The resistance arrangement of a waist-twisting machine of claim 1, wherein the resistance-adjustable apparatus comprises an adjustable hydraulic cylinder, an adjustable pneumatic cylinder, or a spring.

* * * * *